US011118544B2

(12) United States Patent
Poisson et al.

(10) Patent No.: US 11,118,544 B2
(45) Date of Patent: Sep. 14, 2021

(54) HYDROCARBON ADSORBER ON HIGH-FREQUENCY RESONATOR

(71) Applicant: Mahle International GmbH, Stuttgart (DE)

(72) Inventors: Gilbert Poisson, Sterling Heights, MI (US); Lorenzo Fontana, Rochester Hills, MI (US)

(73) Assignee: Mahle International GmbH

( * ) Notice: Subject to any disclaimer, the term of this patent is extended or adjusted under 35 U.S.C. 154(b) by 229 days.

(21) Appl. No.: 16/220,145

(22) Filed: Dec. 14, 2018

(65) Prior Publication Data

US 2020/0191102 A1 Jun. 18, 2020

(51) Int. Cl.
*F02M 35/024* (2006.01)
*F02M 35/12* (2006.01)
(Continued)

(52) U.S. Cl.
CPC ..... *F02M 35/0218* (2013.01); *F02M 35/024* (2013.01); *F02M 35/10144* (2013.01); *F02M 35/12* (2013.01)

(58) Field of Classification Search
CPC ..... F01N 3/021; F01N 3/0217; F01N 3/0807; F01N 3/0835; F01N 13/001;
(Continued)

(56) References Cited

U.S. PATENT DOCUMENTS 7,918,912 B2 4/2011 Tomlin et al.
8,205,442 B2 6/2012 Dobert et al.
(Continued)

FOREIGN PATENT DOCUMENTS

CN 102654089 A 9/2012
CN 101598084 B 2/2013
KR 101636930 B1 7/2016

OTHER PUBLICATIONS

English Abstract for KR101636930B1.
Chinese Office Action dated Jun. 2, 2021 for copending Chinese Patent Appl. No. CN201911273279.X (with English translation).

*Primary Examiner* — T. Bennett McKenzie
*Assistant Examiner* — Qianping He
(74) *Attorney, Agent, or Firm* — Fishman Stewart PLLC

(57) ABSTRACT

A high-frequency resonator forming a flow passage for an air induction system, includes an outer shell having a cylindrical inner surface at a first radial distance from a centerline, and an inner shell positioned within the outer shell and forming a volume therebetween. The inner shell includes a first cylindrical outer surface positioned at a second radial distance from the centerline, the first cylindrical outer surface forming an inner surface of the volume and having a first plurality of resonator openings, and a cylindrical support structure having a second cylindrical outer surface positioned at a third radial distance from the axial centerline, and having hydrocarbon adsorber openings. The resonator includes a hydrocarbon adsorber positioned over the cylindrical support structure, such that an inner surface of the hydrocarbon adsorber is exposed to the flow passage through the hydrocarbon adsorber openings. The third radial distance is less than the first radial distance.

23 Claims, 6 Drawing Sheets

(51) Int. Cl.
*F02M 35/02* (2006.01)
*F02M 35/10* (2006.01)

(58) Field of Classification Search
CPC ..... F01N 13/007; F01N 2490/02; B01D 46/0002; B01D 53/04; B01D 53/14; B01D 53/34; B01D 53/92; B01D 2201/30; B01D 2258/01; B01D 2279/30; B01D 2279/60; F02M 35/161; F02M 35/0218; F02M 35/024; F02M 35/10144; F02M 35/12
USPC ..... 95/143, 116; 123/519
See application file for complete search history.

(56) References Cited

U.S. PATENT DOCUMENTS

| | | | | |
|---|---|---|---|---|
| 8,485,311 | B2 * | 7/2013 | Mackenzie | F02M 35/10137 181/229 |
| 2003/0085071 | A1 * | 5/2003 | Boast | F01N 1/02 181/249 |
| 2005/0241479 | A1 * | 11/2005 | Lebowitz, I | B01D 53/02 95/146 |
| 2007/0186904 | A1 | 8/2007 | Braithwaite et al. | |
| 2007/0292816 | A1 * | 12/2007 | Miller | G01F 5/00 432/180 |
| 2010/0089372 | A1 | 4/2010 | Bellis et al. | |
| 2012/0222641 | A1 | 9/2012 | Mackenzie et al. | |

* cited by examiner

HYDROCARBON ADSORBER ON HIGH-FREQUENCY RESONATOR

BACKGROUND

Air induction systems for automobile engines typically include a pathway for atmospheric air to pass from an air inlet and ultimately to a cylinder head feeding into the combustion chamber. In such a system, either in naturally aspirated engines or in engines having a turbo-compressor, atmospheric air enters a dirty air inlet, passes through an air cleaner that includes a filter element, through a clean air duct, and to an air intake manifold. Clean air is distributed throughout the engine and to the cylinder heads via the air intake manifold.

When the engine is running, air passes from the dirty air inlet and ultimately as clean air to the air intake manifold. However, because of the open pathway from the dirty air inlet to the air intake manifold, engines typically include a direct pathway for hydrocarbon pollutants to pass in the reverse direction from the cylinder head and to the dirty air inlet. Thus, when the engine is shut off, remaining or un-combusted fuel in the engine may pass through the intake manifold, through the clean air duct, and the air cleaner, to the dirty air inlet—and ultimately to the environment. Fuel and hydrocarbons emitted in this fashion are thus a pollutant that must be mitigated according to many environmental standards. And, although the hydrocarbons emitted to the environment pass through the filter element, the filter element itself is typically a paper element and therefore does not include any hydrocarbon adsorber. The hydrocarbon emissions thereby pass to the dirty air inlet and emit to the environment as a hydrocarbon pollutant. Accordingly, it is common to include hydrocarbon adsorbers in air induction systems that adsorber hydrocarbons as they pass through the air intake system from the engine to the environment.

During operation and as discussed, air is drawn into the engine via the air induction system and contaminants and particulate are removed via the filter element, passing also through the flow path of the resonator. During the rapid valve operation of the engine during operation, air is correspondingly and very rapidly accelerated and decelerated, causing a moving column of air to compress and reverberate within the air induction system. An incoming column of air thereby encounters a valve that, when it closes, results in a pressure wave that travels backward (or toward the air inlet) at the speed of sound, which is known as a first harmonic. This occurs for each of the multiple pistons within the engine and, it can also result in excessive acoustic noise generation.

As such, engine induction systems often include a high-frequency Helmholz resonator within the air induction system to decrease engine noise. The resonator typically includes an open, central, flow path or passageway, and a chamber that surrounds the flow path this is one possible resonator design and is one example of this application. The cavity or chamber is accessed via a plurality of holes that are positioned between the flow path and the chamber, which allows for the reverberating pressure waves to expand into the chamber, thereby slowing the reverberating waves in the reverse direction. Such operation dampens the intake noise, improves engine efficiency, and quiets the engine.

The flow passage of the resonator provides an open or free-flowing pathway from the dirty air inlet to the air intake manifold—and vice versa. Thus, the resonator often provides a convenient location and structure to also include a hydrocarbon adsorber. According to one known design, the hydrocarbon adsorber is placed within the chamber of the resonator, and radially external to the resonator holes as a "pass by" hydrocarbon adsorber. However, when the engine is turned off, hydrocarbons thereby pass through the chamber, but only incidentally contact the hydrocarbon adsorber and the resonator holes themselves can present a barrier for the passing hydrocarbons. Thus, this sort of "pass by" hydrocarbon adsorber may only adsorb a limited amount of hydrocarbon because the hydrocarbon is removed from the flow path.

One known solution to overcome such limitations is to provide a hydrocarbon adsorber within the filter element housing itself. In one version of this design, the hydrocarbon adsorber may again be a "pass by" design with the hydrocarbon adsorber being positioned on one or more inner walls of a structure that houses the filter element. Another version may include placement of the hydrocarbon adsorber on the filter element itself, as the hydrocarbon adsorber may be placed after the filter, with the typical flow from dirty to clean air side, in a "pass through" design, and in this design the hydrocarbons emitted from the engine to the environment pass through the hydrocarbon adsorber. Although such a design can have improved hydrocarbon absorption capability, it does so at the potential expense of reduced engine performance, as the hydrocarbon adsorber can hinder air flow into the engine during engine operation. Thus, the improved hydrocarbon absorption in such an arrangement may come at the price of overall engine efficiency.

Accordingly, there is a need for an improved hydrocarbon adsorber in an engine.

BRIEF DESCRIPTION OF THE DRAWINGS

Referring now to the drawings, exemplary illustrations are shown in detail. Although the drawings represent representative examples, the drawings are not necessarily to scale and certain features may be exaggerated to better illustrate and explain an innovative aspect of an illustrative example. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows.

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein of a high-frequency resonator forming a flow passage for an air induction system and method of fabricating same.

An exemplary high-frequency resonator includes an outer shell having a cylindrical inner surface positioned at a first radial distance from an axial centerline, and an inner shell positioned within the outer shell and forming a volume therebetween. The inner shell includes a first cylindrical outer surface positioned at a second radial distance from the axial centerline, the first cylindrical outer surface forming an inner surface of the volume and having a first plurality of resonator openings. A cylindrical support structure having a second cylindrical outer surface is positioned at a third radial distance from the axial centerline, the cylindrical support structure having hydrocarbon adsorber openings. A hydrocarbon adsorber is positioned over the cylindrical support structure, such that an inner surface of the hydrocarbon adsorber is exposed to the flow passage through the hydrocarbon adsorber openings. In such fashion, in one example, the hydrocarbon adsorber is positioned at a radial location that is approximately equal to that of the resonator openings. Thus, rather than having to pass through the resonator holes before becoming in contact with the hydrocarbon adsorber, openings within the cylindrical support structure provide a radial mounting location that is directly exposed to any hydrocarbons as they pass through the resonator. Absorption of the hydrocarbons on the hydrocarbon adsorbers are therefore increased, and more efficiently captured, in contrast to a design having the hydrocarbon adsorber at a location that is radially external to the resonator openings. In one example, the third radial distance is less than the first radial distance.

Figure 1:
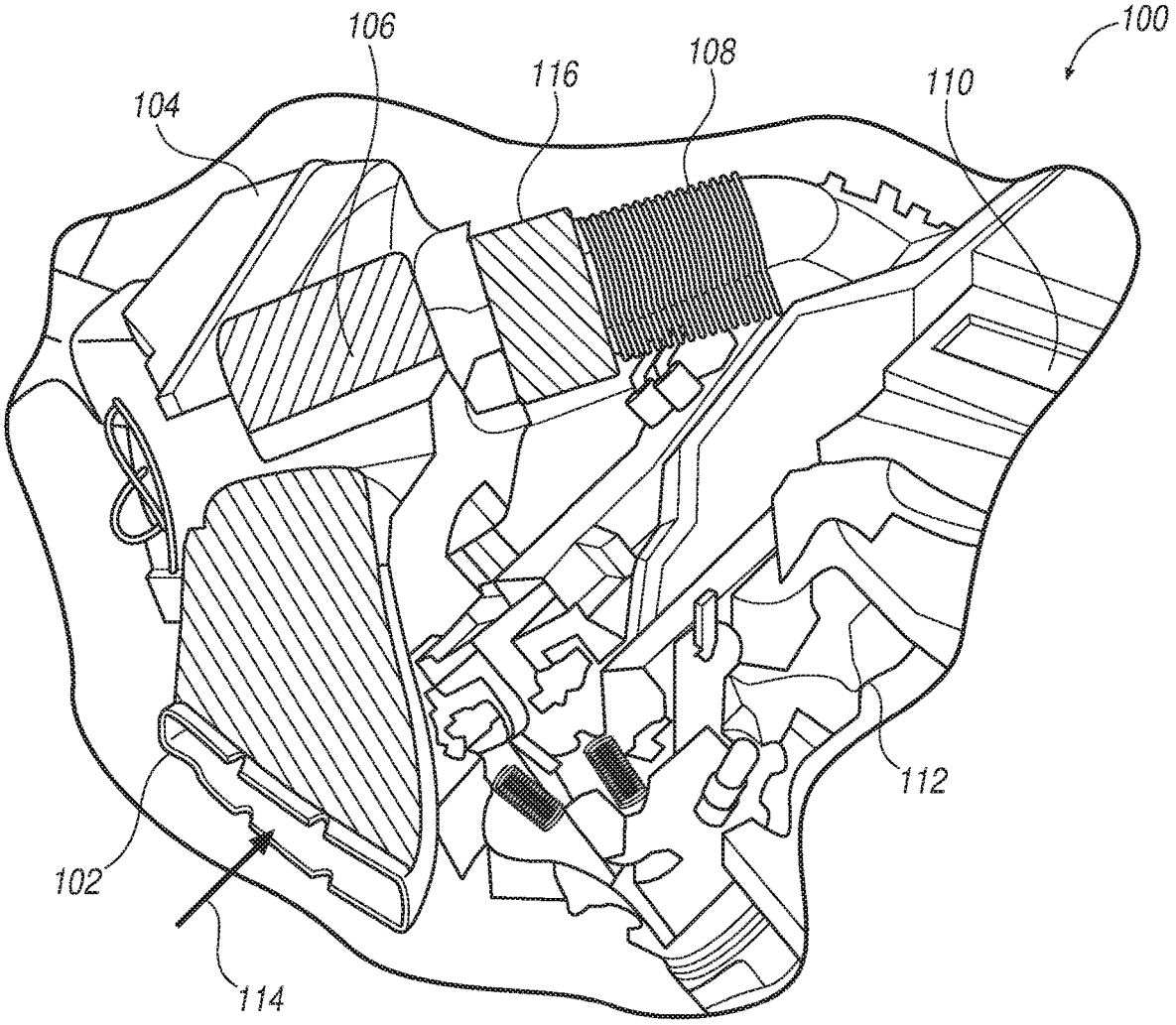
FIG. 1 illustrates an exemplary air induction system, according to the disclosure.

Turning now to FIG. 1, an exemplary air induction system 100 for an engine is illustrated. Air induction system 100 includes a dirty air inlet 102, and an air cleaner 104 having a filter element 106. A clean air duct 108 is connected to air cleaner 104, and clean air duct 108 is fluidly connected to an air intake manifold 110, which distributes air from clean air duct 108 to a cylinder head 112. Air induction system 100 includes a high-frequency resonator 116 as will be further disclosed.

In operation, dirty air 114 passes into dirty air inlet 102, through air cleaner 104, and through high-frequency resonator 116 as clean air. The clean air passes from high-frequency resonator 116 and into clean air duct 108, then to air intake manifold 110 and ultimately to cylinder head 112 to support combustion within the engine. High-frequency resonator 116 reduces acoustic noise by suppressing the acoustic noise generated at the first and beyond harmonic frequencies, as will be further discussed.

However, in further operation, when the engine is shut down and is no longer running, operation of air induction system 100 further includes hydrocarbons that emanate from cylinder head 112, through air intake manifold 110 and through clean air duct 108 and to high-frequency resonator 116. According to the disclosure, high-frequency resonator 116 includes a hydrocarbon adsorber that is positioned proximate the flow of hydrocarbons that are emitted from cylinder head 112, as will be further discussed, which adsorbs the hydrocarbons emitted from the engine.

Figure 2:
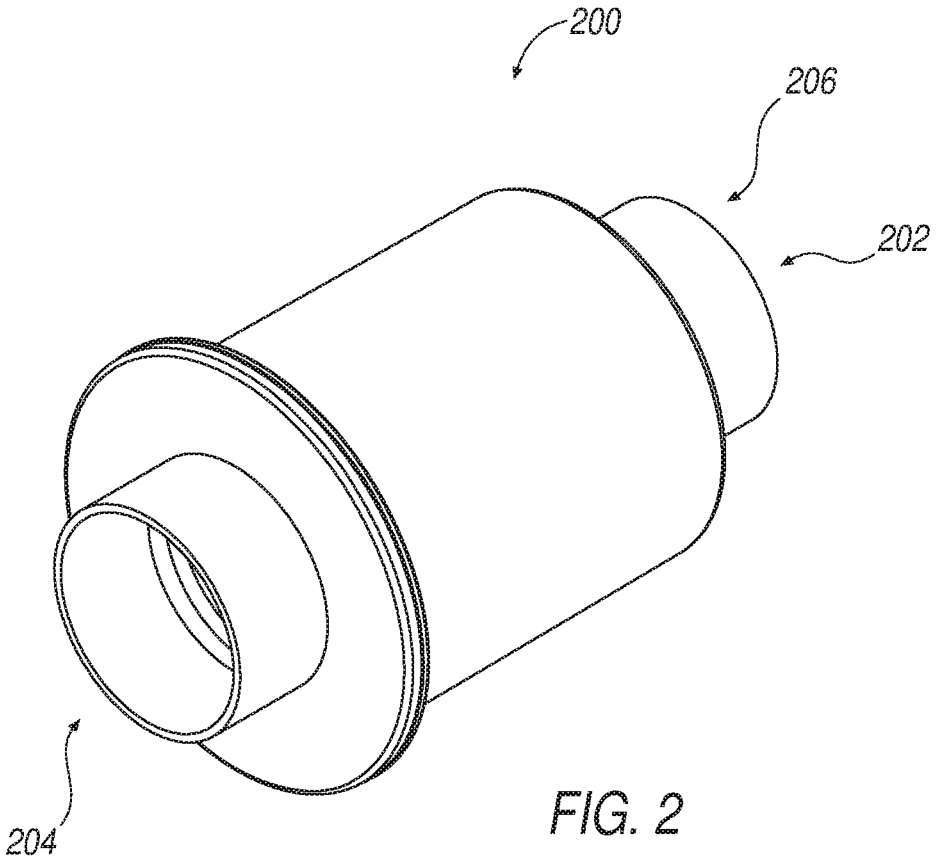
FIG. 2 shows an exemplary high-frequency resonator of FIG. 1.

Turning now to FIG. 2, high-frequency resonator 116 of FIG. 1 is illustrated as high-frequency resonator assembly 200. Assembly 200 includes an inlet 202 and an outlet 204, and a flow passage 206.

Figure 3:
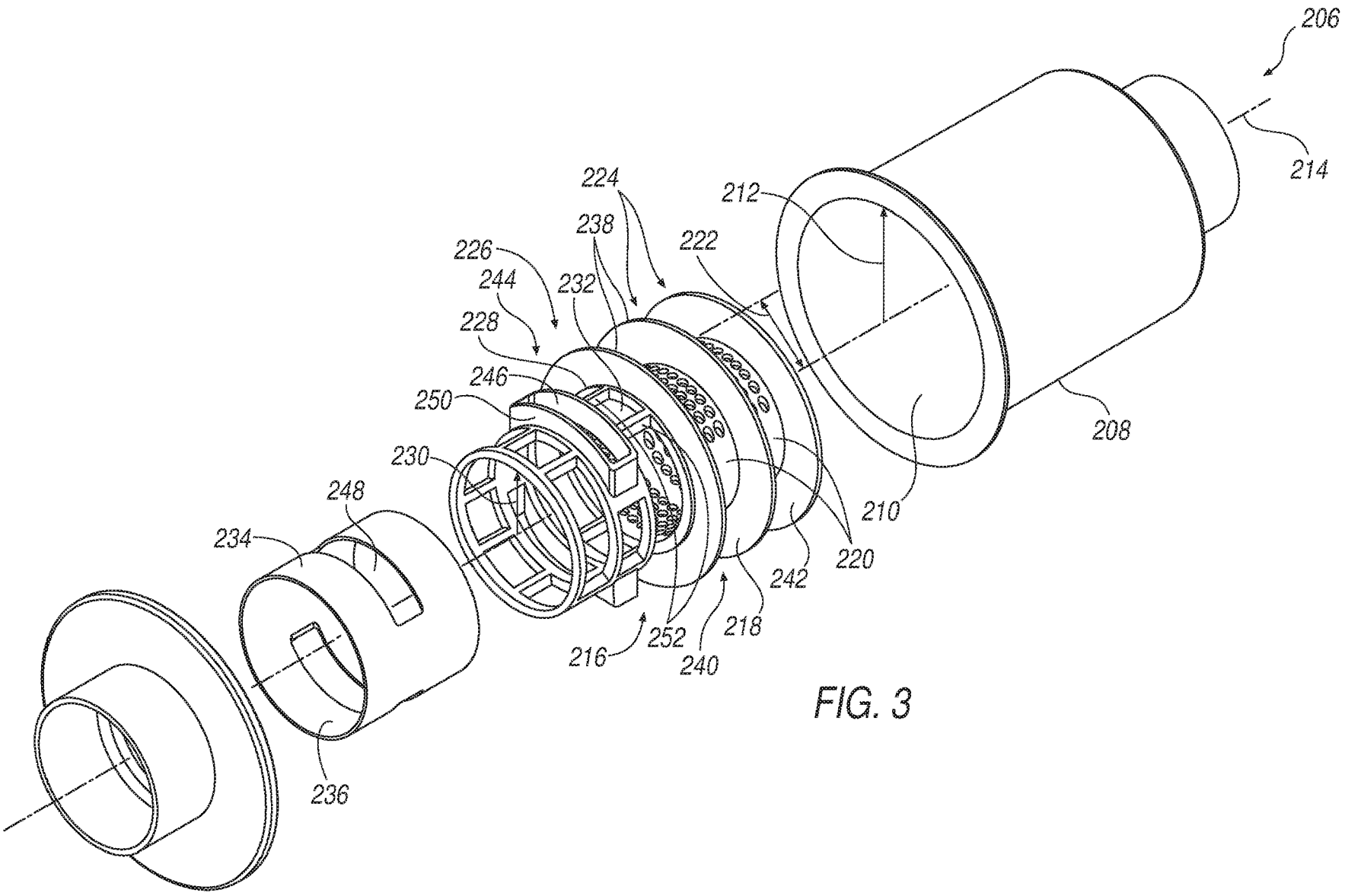
FIG. 3 shows high-frequency resonator assembly of FIG. 2 in expanded view.
Figure 4:
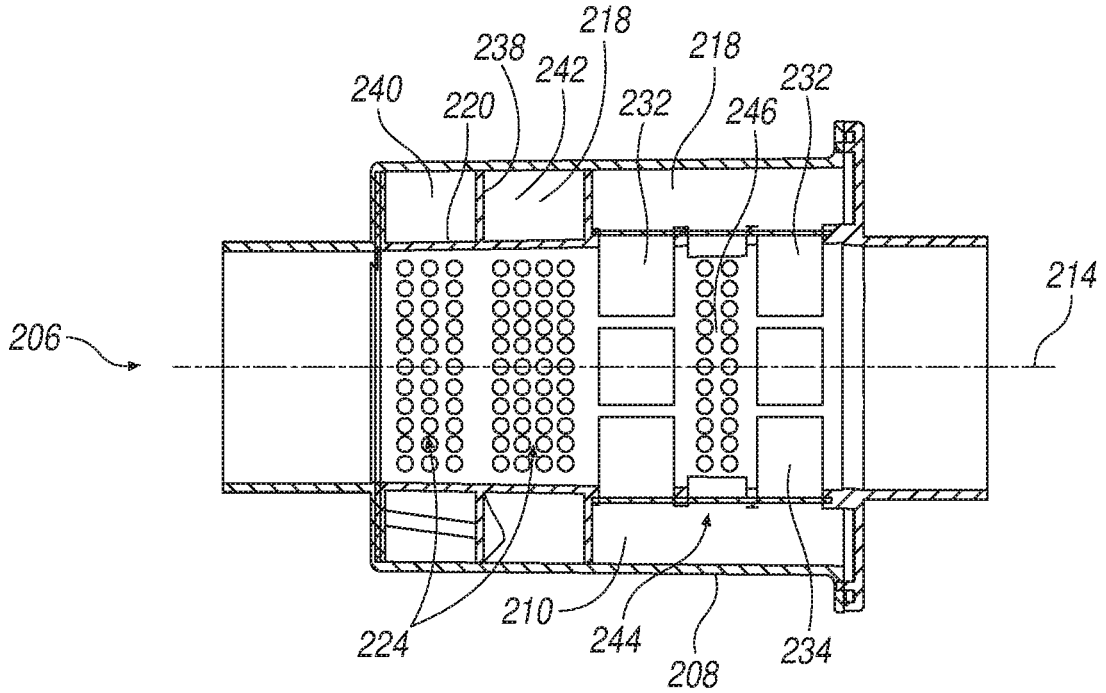
FIG. 4 shows high-frequency resonator assembly of FIG. 2 in cross-section.

FIG. 3 shows high-frequency resonator assembly 200 in expanded view, and FIG. 4 shows a cutaway view of high-frequency resonator assembly 200 in its assembled form. High-frequency resonator assembly 200 forms flow passage 206 for air induction system 200, and includes an outer shell 208 having a cylindrical inner surface 210 at a first radial distance 212 from an axial centerline 214. An inner shell 216 is positioned within outer shell 208 and forms a volume 218 therebetween. Inner shell 216 includes a first cylindrical outer surface 220 positioned at a second radial distance 222 from axial centerline 206. First cylindrical outer surface 220 forms an inner surface of volume 218 and includes a first plurality of resonator openings 224. A cylindrical support structure 226 includes a second cylindrical outer surface 228 positioned at a third radial distance 230 from axial centerline 214, cylindrical support structure 226 having hydrocarbon adsorber openings 232. A hydrocarbon adsorber 234 is positioned over cylindrical support structure 226, such that an inner surface 236 of hydrocarbon adsorber 234 is exposed to flow passage 206 through the hydrocarbon adsorber openings. Third radial distance 230 is less than first radial distance 212.

Inner shell 216 includes one or more axial splitters 238 attached to first cylindrical outer surface 222 and divides volume 218 into a first portion 240 having some of the first plurality of the resonator openings 224, and a second portion 242 having some of the first plurality of the resonator openings 224. The height of axial splitters 238 and spaces forming first portion 240 and second portion 242 may change, based on desired frequency of operation and as understood within the art. Cylindrical support structure 226 includes a window passageway 244 having a second plurality of resonator openings 246. Hydrocarbon adsorber 234 includes an aperture 248 that corresponds with window passageway 244. Second plurality of resonator openings 246 pass through cylindrical support structure 226 and within window passageway 244. Cylindrical support structure 226 further includes a rim 250 that surrounds window passageway 244 and rim 250 extends radially outward from third radial distance 230, capturing hydrocarbon adsorber 234 within aperture 248.

In one example, second radial distance 222 is the same as third radial distance 230, however it is contemplated that the radial distances may differ from one another. Cylindrical support structure 226 includes a plurality of axial supports 252 that support hydrocarbon adsorber 234.

Accordingly, hydrocarbons emitted from cylinder head 112 are efficiently adsorbed by hydrocarbon adsorber 234, having its inner surface 236 positioned immediately proximate to the hydrocarbons as they pass through flow passage 206 of high-frequency resonator assembly 200. And, there is no detrimental effect in resonator performance, as resonator openings 224 provide access to volume 218 such that pressure waves pass thereto.

Figure 5:
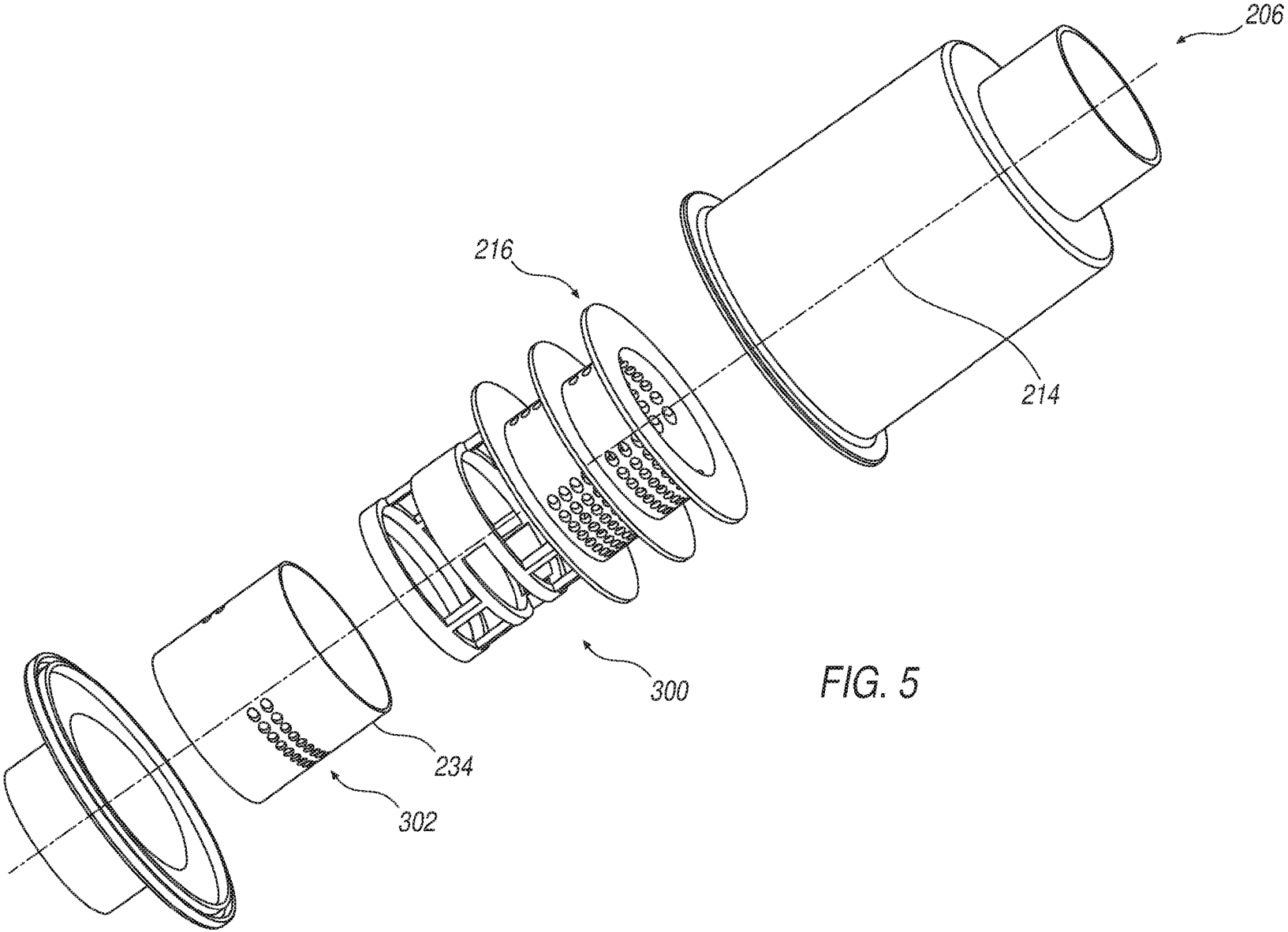
FIG. 5 shows a high-frequency resonator of FIG. 1 according to another exemplary arrangement.
Figure 6:
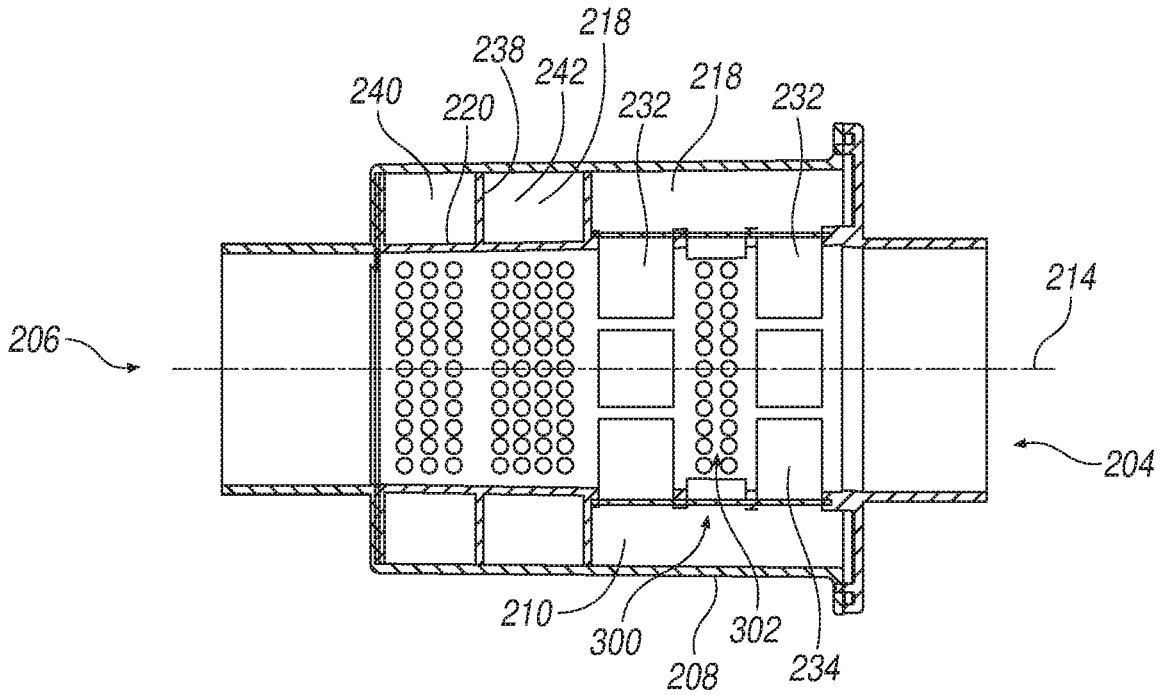
FIG. 6 shows high-frequency resonator assembly of FIG. 5 in cross-section.

FIG. 5 shows high-frequency resonator assembly 200 in an expanded view, according to another example, and FIG. 6 shows a cutaway view of high-frequency resonator assembly 200 of FIG. 5 in its assembled form. In this example, high-frequency resonator assembly 200 includes elements corresponding to FIGS. 3, and 4, subject to the following exceptions. In one example, in lieu of including a window passageway, rim, and resonator openings in the inner shell, a window 300 is included in inner shell 216. In this example, hydrocarbon adsorber 234 includes its own resonator openings 302.

As such, according to the disclosure, resonator holes may be positioned either within an inner shell, or within the hydrocarbon adsorber itself. Thus, during operation, air passes ultimately to the cylinder head to support combustion within the engine, which includes passing through the high-frequency resonator. The high-frequency resonator thereby reduces acoustic noise by suppressing the acoustic noise generated at the first and beyond harmonic frequencies, by having resonator holes that allow for passage of pressure waves into a cavity or chamber, such as volume 218, that surrounds the flow path, slowing the reverberating waves in the reverse direction. The chamber is accessed via the plurality of holes that are positioned between the flow path and the chamber that surrounds the flow path. Providing a cavity or chamber for the air reverberation thus dampens the intake noise, improves engine efficiency, and quiets the engine.

And, when the engine is shut down and is no longer running, hydrocarbons that emanate from the cylinder head pass ultimately through the high-frequency resonator, and are thereby exposed to hydrocarbon adsorber 234.

Disclosed also is a method of fabricating a high-frequency resonator that forms a flow passage for an air induction system. The method includes forming an outer shell having a cylindrical inner surface at a first radial distance from an axial centerline, and positioning an inner shell within the outer shell to define a volume therebetween. Defining the inner shell includes positioning a first cylindrical outer surface at a second radial distance from the axial centerline such that the first cylindrical outer surface forms an inner surface of the volume, the first cylindrical outer surface having a first plurality of resonator openings, defining a cylindrical support structure having a second cylindrical outer surface positioned at a third radial distance from the axial centerline, the cylindrical support structure having hydrocarbon adsorber openings, and positioning a hydrocarbon adsorber over the cylindrical support structure, such that an inner surface of the hydrocarbon adsorber is exposed to the flow passage through the hydrocarbon adsorber openings. It is contemplated that resonator and its components are fabricated from plastics and formable metals, such as aluminum, steel, and the like. However, it is further contemplated that the resonator and its components may be fabricated from any material, so long as structural integrity is maintained at operating temperature, and during the life of the resonator. Further, the resonator is sufficiently robust to withstand chemical and other exposure that may occur with emissions from the cylinder head.

Positioning the cylindrical support structure includes having a window passageway that includes a second plurality of resonator openings, and positioning the hydrocarbon adsorber having an aperture that corresponds with the window passageway.

Positioning the cylindrical support structure having a rim that surrounds the window passageway and extends radially outward from the third radial distance, capturing the hydrocarbon adsorber within the aperture. Further positioning the cylindrical support structure having a plurality of axial supports to support the hydrocarbon adsorber. The positioning of the components may further include securing the assembly together use various methods as are well known in the art, some of which include gluing, welding, riveting, forming or wrapping the adsorber in the supports of the frame. In addition, the adsorber may be secured in place by overmolding the absorber on or in the frame.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be understood upon reading the above description. It is anticipated and intended that future developments will occur in the arts discussed herein, and that the disclosed systems and methods will be incorporated into such future embodiments. In sum, it should be understood that the invention is capable of modification and variation.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A high-frequency resonator forming a flow passage for an air induction system, comprising:

an outer shell having an inner surface at a first distance from an axial centerline;

an inner shell positioned within the outer shell and centered about the axial centerline, and forming a volume therebetween, the inner shell comprising:

a first cylindrical outer surface positioned at a second radial distance from the axial centerline, the first cylindrical outer surface forming an inner surface of the volume and having a first plurality of resonator openings;

a cylindrical support structure having a second cylindrical outer surface positioned at a third radial distance from the axial centerline, the cylindrical support structure having hydrocarbon adsorber openings; and a hydrocarbon adsorber positioned over the cylindrical support structure, such that an inner surface of the hydrocarbon adsorber is exposed to the flow passage through the hydrocarbon adsorber openings;

wherein the third radial distance is less than the first radial distance; and wherein the cylindrical support structure includes a window passageway having a second plurality of resonator openings, and wherein the hydrocarbon adsorber includes an aperture that corresponds with the window passageway.

2. The high-frequency resonator of claim 1, further comprising an axial splitter attached to the first cylindrical outer surface that divides the volume into at least a first portion and a second portion, the first portion having a subset of the first plurality of the resonator openings, and the second portion having a subset of the first plurality of the resonator openings.

3. The high-frequency resonator of claim 1, wherein the second plurality of resonator openings pass through the cylindrical support structure and within the window passageway.

4. The high-frequency resonator of claim 1, wherein the cylindrical support structure further comprises a rim that surrounds the window passageway and the rim extends radially outward from the third radial distance, capturing the hydrocarbon adsorber within the aperture.

5. The high-frequency resonator of claim 1, wherein the second radial distance is the same as the third radial distance.

6. The high-frequency resonator of claim 1, wherein the cylindrical support structure includes a plurality of axial supports that support the hydrocarbon adsorber.

7. The high-frequency resonator of claim 1, wherein the aperture and the window passageway coincide with one another.

8. A method of fabricating a high-frequency resonator that forms a flow passage for an air induction system, comprising:

forming an outer shell having a cylindrical inner surface at a first radial distance from an axial centerline;

positioning an inner shell within the outer shell to define a volume therebetween, wherein positioning the inner shell includes:

defining a first cylindrical outer surface at a second radial distance from the axial centerline such that the first cylindrical outer surface forms an inner surface of the volume, the first cylindrical outer surface having a first plurality of resonator openings;

defining a cylindrical support structure having a second cylindrical outer surface positioned at a third radial distance from the axial centerline, the cylindrical support structure having hydrocarbon adsorber openings; and positioning a hydrocarbon adsorber over the cylindrical support structure, such that an inner surface of the hydrocarbon adsorber defines a portion of the flow passage through the hydrocarbon adsorber openings;

wherein the third radial distance is less than the first radial distance; and wherein positioning the cylindrical support structure includes positioning the cylindrical support structure having a window passageway that includes a second plurality of resonator openings, and positioning the hydrocarbon adsorber includes positioning the hydrocarbon adsorber having an aperture that corresponds with the window passageway.

9. The method of claim 8, wherein positioning the first cylindrical outer surface includes positioning an axial splitter that divides the volume into a first portion having some of the first plurality of resonator openings, and a second portion having some of the first plurality of resonator openings.

10. The method of claim 8, wherein the second plurality of resonator openings pass through the cylindrical support structure and within the window passageway.

11. The method of claim 8, wherein positioning the cylindrical support structure includes positioning the cylindrical support structure having a rim that surrounds the window passageway and extends radially outward from the third radial distance, capturing the hydrocarbon adsorber within the aperture.

12. The method of claim 8, wherein the second radial distance is the same as the third radial distance.

13. The method of claim 8, wherein positioning the cylindrical support structure comprises positioning the cylindrical support structure having a plurality of axial supports that support the hydrocarbon adsorber.

14. The method of claim 8, wherein positioning the cylindrical support structure includes positioning the hydrocarbon adsorber such that the aperture and the window passageway coincide with one another.

15. An air induction system, comprising:

a clean air duct connected to an air intake manifold and having a filter element attached thereto; and a high-frequency resonator surrounding the clean air duct, the high-frequency resonator comprising:

an outer shell having a cylindrical inner surface at a first radial distance from an axial centerline;

an inner shell positioned within the outer shell and forming a volume therebetween, the inner shell comprising:

a first cylindrical outer surface positioned at a second radial distance from the axial centerline, the first cylindrical outer surface forming an inner surface of the volume and having a first plurality of resonator openings;

a cylindrical support structure having a second cylindrical outer surface positioned at a third radial distance from the axial centerline, the cylindrical support structure having hydrocarbon adsorber openings; and a hydrocarbon adsorber positioned over the cylindrical support structure, such that an inner surface of the hydrocarbon adsorber is exposed to the flow passage through the hydrocarbon adsorber openings;

wherein the third radial distance is less than the first radial distance; and wherein the cylindrical support structure includes a window passageway having a second plurality of resonator openings, and wherein the hydrocarbon adsorber includes an aperture that corresponds with the window passageway.

16. The air induction system of claim 15, wherein the high-frequency resonator further comprises an axial splitter attached to the first cylindrical outer surface that divides the volume into a first portion having some of the first plurality of resonator openings, and a second portion having some of the first plurality of resonator openings.

17. The air induction system of claim 15, wherein the aperture and the window passageway coincide with one another.

18. The air induction system of claim 15, wherein the second plurality of resonator openings pass through the cylindrical support structure and within the window passageway.

19. The air induction system of claim 15, wherein the cylindrical support structure further comprises a rim that surrounds the window passageway and extends radially outward from the third radial distance, capturing the hydrocarbon adsorber within the aperture.

20. The air induction system of claim 15, wherein the second radial distance is the same as the third radial distance, and wherein the cylindrical support structure includes a plurality of axial supports that support the hydrocarbon adsorber.

21. A high-frequency resonator forming a flow passage for an air induction system, comprising:

an outer shell having an axial centerline;

an inner shell positioned within the outer shell and centered about the axial centerline, and forming a volume therebetween, the inner shell comprising:

a cylindrical outer surface forming an inner surface of the volume and having a first plurality of resonator openings;

a cylindrical support structure having hydrocarbon adsorber openings; and a hydrocarbon adsorber positioned over the cylindrical support structure, such that an inner surface of the hydrocarbon adsorber is at a radial distance from the axial centerline that is greater than a radial distance from the axial centerline to the cylindrical outer surface;

wherein the cylindrical support structure includes a window passageway having a second plurality of resonator openings.

22. The high-frequency resonator of claim 21, wherein the hydrocarbon adsorber includes an aperture that corresponds with the window passageway.

23. The high-frequency resonator of claim 21, wherein the aperture and the window passageway coincide with one another.

* * * * *